US005106131A

United States Patent [19]

Willcox

[11] Patent Number: 5,106,131

[45] Date of Patent: Apr. 21, 1992

[54] SELF-CLOSING GATE LATCH

[76] Inventor: Glen M. Willcox, 1201 East Irving Blvd., Irving, Tex. 75060

[21] Appl. No.: 697,077

[22] Filed: May 8, 1991

[51] Int. Cl.[5] ..... E05C 3/14

[52] U.S. Cl. ..... 292/52; 292/304

[58] Field of Search ..... 292/49, 52, 54, 304, 292/DIG. 14, 46

[56] References Cited

U.S. PATENT DOCUMENTS

| | | | |
|---|---|---|---|
| 160,639 | 3/1875 | Bernard | 292/52 |
| 232,789 | 9/1880 | Walker | 292/54 |
| 484,752 | 10/1892 | Hoffman | 292/54 |
| 596,234 | 12/1897 | Whitney et al. | 292/54 |
| 1,216,765 | 2/1917 | Anderson | 292/44 |
| 1,434,325 | 10/1922 | Brown | 292/238 |
| 1,528,093 | 3/1925 | Anderson | 292/238 X |
| 1,574,023 | 2/1926 | Crompton et al. | 292/44 X |
| 3,386,758 | 6/1968 | Swearingen | 292/53 |
| 3,897,965 | 8/1975 | Miller | 292/194 |
| 3,904,230 | 9/1975 | Fane et al. | 292/49 |
| 4,133,142 | 1/1979 | Dzus, Jr. | 292/254 X |
| 4,251,095 | 2/1981 | Marino et al. | 292/54 |
| 4,474,492 | 10/1984 | Fleitas | 292/304 |
| 4,557,511 | 12/1985 | Cohn et al. | 292/238 X |

*Primary Examiner*—Richard E. Moore

*Attorney, Agent, or Firm*—W. Kirk McCord

[57] ABSTRACT

A latching device for releasably securing a fence gate in a closed position includes an elongated catch member mounted adjacent a free end of the gate and projecting therefrom in a direction substantially perpendicular to a major surface of the gate and a latch member mounted on an inner major surface of the fence for engaging the catch member when the catch member penetrates through an opening in the fence, to retain the gate in the closed position. The latch member includes first and second pivotally mounted arm members and a handle depending from the second arm member for co-movement therewith. The catch member includes an enlarged head for penetrating between the first and second arm members to spread the arm members apart sufficiently to allow the head to pass therebetween. After the head clears the arm members, the arm members return to their respective closed positions to retain the head of the catch member in a closed latch position. To release the latching device, the handle is operated to spread the first and second arm members sufficiently to allow the head of the catch member to be retracted back through the opening in the fence, thereby releasing the gate to be opened.

14 Claims, 2 Drawing Sheets

SELF-CLOSING GATE LATCH

FIELD OF THE INVENTION

This invention relates generally to latching mechanisms for fence gates and the like and in particular to a self-closing latch which is releasable only from inside the fence.

BACKGROUND OF THE INVENTION

A latch is typically used to maintain a gate, which is hingedly attached at one end thereof to a fence or the like, in a closed position. The latch is releasable to allow the gate to be opened. The conventional gate latch includes a spring-operated device attached to a stationary part of the fence and having a recess for receiving a catch member mounted adjacent the free end of the gate. The catch member is typically comprised of an elongated bar, oriented substantially parallel to a major surface of the gate and extending past the free end thereof, for engaging the recess in the spring-operated mechanism. The spring-operated mechanism may include a handle to facilitate disengagement of the bar from the recess when it is desired to release the latch.

DESCRIPTION OF THE PRIOR ART

According to prior practice, gate latches are typically mounted on the outside of the fence to accommodate outwardly opening gates. As such, it is difficult to prevent access to the area inside the fence. For example, the latch may be easily disengaged by a young child wishing to enter through the gate. If a swimming pool or other condition which is potentially hazardous to a young child is present within the fence, other means, such as a lock, must be used to prevent the latch from being released.

Latching mechanisms of various types are disclosed in the following U.S. Pat. Nos.: 1,216,765; 1,434,325; 1,528,093; 1,574,023; 3,386,758; 3,897,965; 4,133,142; 4,251,095; 4,474,492; and 4,557,511.

OBJECTS OF THE INVENTION

It is therefore the principal object of the present invention to provide an improved gate latch.

Another object of the invention is to provide self-closing latch.

Yet another object of the invention is to provide a latch for releasably securing a fence gate, such that the latch is releasable only from inside the fence.

Still another object of the invention is to provide a latch for a fence gate, which is secured by the engagement between a first latch member attached to the gate and a second latch member on the inside of the fence.

SUMMARY OF THE INVENTION

These and other objects are accomplished in accordance with the present invention wherein a latching device is provided for releasably securing a fence gate in a closed position. The gate is pivotally attached at one end thereof to the fence, so that an opposite end of the gate is a free end, which can be swung toward and away from the fence. The latching device includes first latch means mounted on the gate adjacent the opposite end thereof and second latch means mounted on an inner major surface of the fence. The first latch means includes an elongated catch member projecting therefrom in a direction substantially perpendicular to a major surface of the gate. The second latch means includes means for engaging the catch member when the catch member penetrates through an opening in the fence, to retain the gate in the closed position. User operable means is provided for disengaging the catch member, to allow the gate to be opened.

In accordance with a unique feature of the invention, the catch member includes an enlarged head, a leading portion of which is rounded and a trailing portion of which is relatively flat to define a shoulder portion. In accordance with another unique feature of the invention, the second latch means includes a housing with first and second arm members pivotally mounted therein and an aperture extending therethrough in alignment with the fence opening, for receiving the catch member. The first and second arm members are movable between respective first positions at which the first and second arm members extend into the aperture to define a closed latch position and respective second positions at which the first and second arm members are retracted from the aperture to define an open latch position. The second latch means further includes a handle depending from the second arm member and protruding from the housing. One end of the first arm member is in sliding engagement with the handle, such that the handle is manually operable for moving first and second arm members from the closed latch position to the open latch position. The first and second arm members are biased toward the closed latch position, such that when manual operation of the handle ceases, the first and second arm members return to the respective first positions, which corresponds to the closed latch position.

In the preferred embodiment, respective portions of the first and second arm members which extend into the aperture when the first and second arm members are in the respective first positions are beveled for urging the head of the catch member between the first and second arm members. As the catch member penetrates between the first and second arm members, the rounded portion of the head, slides along the beveled portions of the first and second arm members and spreads the first and second arm members apart sufficiently to allow the head to penetrate past the arm members. After the head of the catch member clears the arm members, the first and second arm members will return to the respective first positions to retain the catch member in the aperture. The relatively flat shoulder portion of the head engages respective relatively flat surfaces of the first and second arm members, to prevent the catch member from being disengaged from the first and second arm members when the first and second arm members are in the respective first positions.

To disengage the catch member from the first and second arm members, the handle is manually operated to separate the first and second arm members, thereby providing sufficient clearance for the head to be retracted back through the aperture.

DETAILED DESCRIPTION OF THE PREFERRED EMBODIMENT

Figure 1:
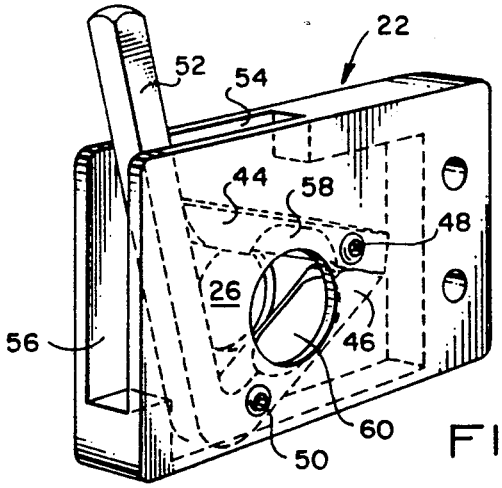
FIG. 1 is a perspective view of a fence-mounted portion of a gate latch, according to the present invention.

In the description which follows, like parts are indicated throughout the specification and drawings with the same respective reference numerals. The drawings are not necessarily to scale and in some instances, proportions have been exaggerated in order to more clearly depict certain features of the invention.

Figure 4:
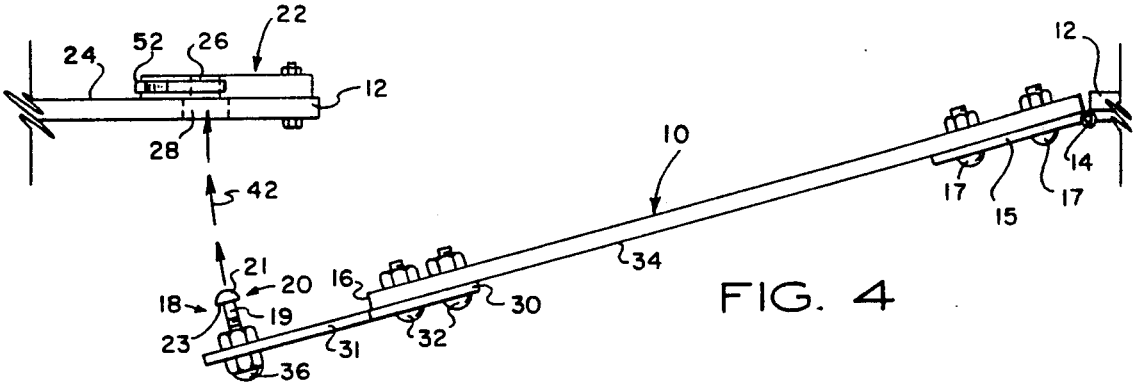
FIG. 4 is a top plan view of a swinging fence gate, illustrating the operation of the gate latch, according to the present invention.
Figure 5:
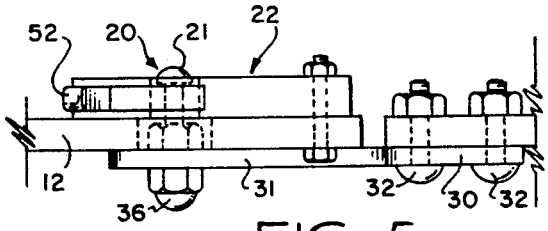
FIG. 5 is a top plan view of the gate latch of FIG. 4 in a closed position.
Figure 6:
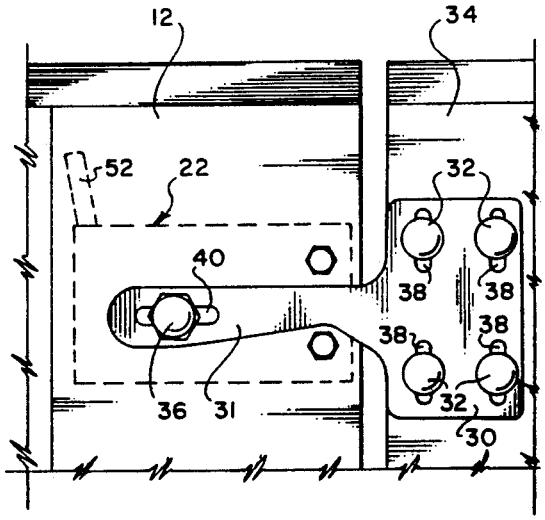
FIG. 6 is an elevation view of the gate latch of FIG. 4 in a closed position.

Referring to FIGS. 4, 5 and 6, a gate 10 is hingedly attached at one end thereof to a stationary fence 12, as indicated at 14, such that an opposite end 16 of gate 10 is free to swing toward and away from fence 12. A hinge plate 15 is attached to gate 10 by means of mounting bolts 17. A latching device is provided for releasably securing gate 10 in a closed position with respect to fence 12. The latching device includes a catch member 18 having an elongated shaft 19 and an enlarged head 20. A leading portion 21 of head 20 is rounded and a trailing portion 23 of head 20 is relatively flat. A housing 22 is mounted on an inner major surface 24 of fence 12. An aperture 26 extends through housing 22 and is aligned with an opening 28 in fence 12 for receiving catch member 18 when gate 10 is in the closed position. A relatively flat plate member 30 is attached by threaded bolts 32 to an outer major surface 34 of gate 10, adjacent free end 16 thereof. A tongue 31 is integrally formed on plate member 30 and extends beyond free end 16 along an axis which is substantially parallel to outer major surface 34. Catch member 18 is attached to tongue 31 by means of mounting bolt 36 and projects from tongue 31 in a direction substantially perpendicular to outer major surface 34. Catch member 18 extends in the general direction of fence 12.

Plate member 30 includes four vertically oriented, elongated slots 38, to allow the position of plate member 30 to be adjusted vertically. Tongue 31 includes a horizontally oriented elongated slot 40 for adjusting the position of catch member 18 horizontally. Therefore, catch member 18 is adjustable both horizontally and vertically to allow catch member 18 to penetrate cleanly through aligned aperture 26 and opening 28 when gate 10 is moved to the closed position, as indicated by arrows 42.

Figure 2:
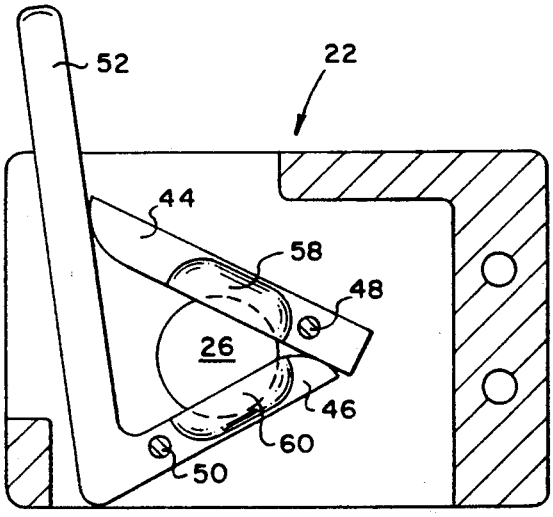
FIGS. 2 and 3 are respective sectional views, showing the gate latch portion of FIG. 1 in the closed and open latch positions, respectively.

Referring now to FIGS. 1 and 2, the latching device according to the present invention includes first and second arm members 44 and 46, pivotally mounted within housing 22 by means of Allen head screws 48 and 50, respectively. A handle 52 is integrally formed at one end of second arm member 46 and projects outwardly from a top opening 54 in housing 22. Handle 52 can be pivoted about the axis of Allen head screw 50, together with second arm member 46. One end of first arm member 44 is in sliding engagement with handle 52, such that first arm member 44 leans against handle 52 and exerts a biasing force urging handle 52 toward open end 56 of housing 22.

When handle 52 is positioned as shown in FIGS. 1 and 2, the latching device is in the closed position. When the latching device is in the closed position, respective portions of first and second arm members 44 and 46 extend into aperture 26, to close off respective portions of aperture 26. The respective portions of first and second arm members 44 and 46 which extend into aperture 26 are beveled on one side thereof, as indicated at 58 and 60, respectively, for slidably engaging rounded portion 21 of head 20 to urge head 20 between first and second arm members 44 and 46, as will be described in greater detail with reference to FIGS. 7-9.

Figure 3:
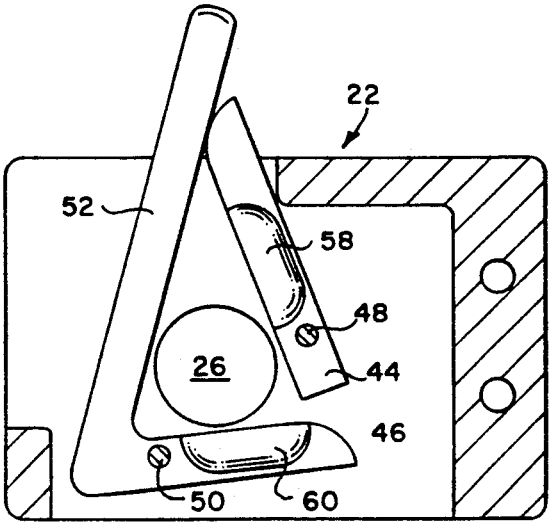

The latching device is released by manually moving handle 52 away from open end 56 to overcome the biasing force exerted by first arm member 44. When handle 52 is moved away from open end 56, first arm member 44 is tilted upwardly and second arm member 46 is pivoted downwardly, as shown in FIG. 3, so that the respective beveled portions 58 and 60 are retracted from aperture 26 to release catch member 18. Catch member 18 can then be retracted back through aperture 26 by swinging free end 16 of gate 10 away from fence 12 (i.e., in a direction opposite to the direction indicated by arrows 42 in FIG. 4).

Figure 7:
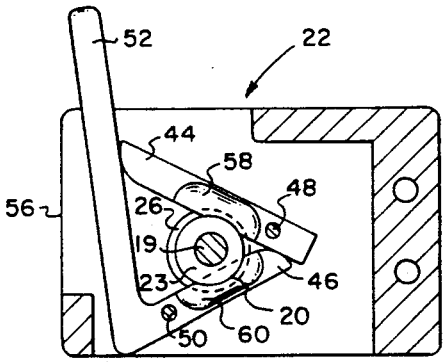
FIGS. 7, 8 and 9 are respective sectional views, illustrating the sequence of operation of the gate latch of FIG. 4.
Figure 8:
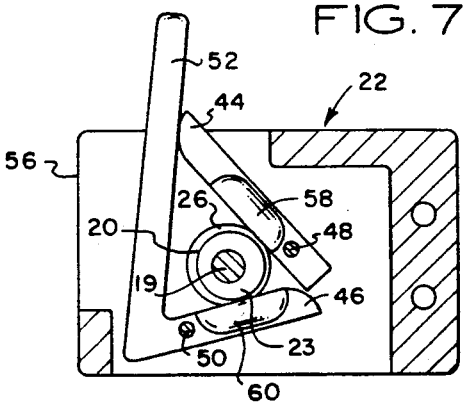
Figure 9:
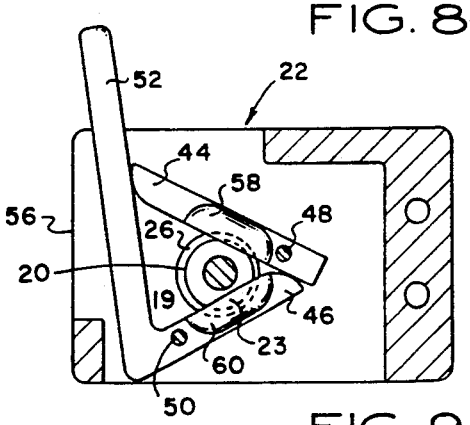

Referring to FIGS. 7-9, the latching device according to the present invention is engaged by introducing head 20 of catch member 18 into aperture 26, such that the rounded portion 21 contacts beveled portions 58 and 60 and is urged between arm members 44 and 46 by the sliding movement of rounded portion 21 along beveled portions 58 and 60, as depicted in FIG. 7.

The penetrating action of head 20 separates first and second arm members 44 and 46, such that said arm members 44 and 46 are retracted out of aperture 26, as shown in FIG. 8. After head 20 passes between arm members 44 and 46, first arm member 44 will pivot downwardly, thereby pivoting handle 52 back toward open end 56 and second arm member 46 upwardly, such that beveled portions 58 and 60 are extended into aperture 26 to close off corresponding portions of aperture 26. As shown in FIG. 9, the latching device is once again in the closed position, with head 20 being retained substantially within aperture 26. Head 20 is prevented from being retracted from aperture 26 by the engagement between shoulder portion 23 of head 20 and the relatively flat back surfaces (not shown) of arm members 44 and 46. To release the latching device, handle 52 is manually operated to spread arm members 44 and 46 apart, as shown in FIG. 8, whereby head 20 can be retracted back through aperture 26.

In accordance with the present invention, an improved gate latch is provided, which includes a self-closing capability on the inside of a fence or other partition. In accordance with a unique feature of the invention, a gate which is opened by swinging the gate away from the fence on the outside thereof is releasably secured in a closed position by a latching device on the inside the fence. The latch is releasable only from inside the fence, to inhibit access to the area inside of the fence by persons, such as small children, who are not able to operate the latching device from outside the fence.

Although the invention has been described with reference to a specific embodiment, the foregoing description is not intended to be construed in a limiting sense. Various modifications to the disclosed embodiment, as well as alternative applications of the invention, will be suggested to person skilled in the art by the foregoing specification and illustrations. It is therefore contemplated that the appended claims will cover any such modifications, applications or embodiments as fall within the true scope of the invention.

What is claimed is:

1. A latching device for releasably securing a gate in a closed position, said gate being pivotally attached at one end thereof to a stationary fence such than an opposite end of the gate is a free end adapted for swinging motion toward and away from the fence, said latching device comprising, in combination:

first latching means mounted on said gate adjacent said free end, said first latching means including a catch member projecting therefrom in a direction substantially perpendicular to a major surface of said gate; and second latching means mounted on a major surface of said fence, said second latching means including first and second arm members pivotally mounted with respect to said fence such that said first and second arms members are selectively engagable with and disengagable from said catch member, an end portion of said first arm member bearing against said second arm member and being in slidable engagement therewith such that said first arm member biases said second arm member toward a closed latch position at which said first and second arm members are in respective first positions for engagement with said catch member, said first and second arm members being disengagable from said catch member by moving said second arm member against said first arm member to overcome the bias exerted on said second arm member by said first arm member, whereby said first and second arm members are movable to respective second positions at which said first and second arm member are disengaged from said catch member.

2. The latching device of claim 1 wherein said catch member includes an elongated shaft and an enlarged head at one end of the shaft, said second latching means being mounted on an inner major surface of said fence, said fence having an opening communicating between an outer major surface of said fence and said inner major surface, said head being adapted to penetrate through said opening to engage said second latch means.

3. The latching device of claim 2 wherein a leading portion of said head is rounded and a trailing portion of said head is relatively flat, such that said trailing portion defines a shoulder extending radially from said shaft.

4. The latching device of claim 1 wherein said fence has an opening communicating between outer and inner major surfaces of said fence, said second latch means including a housing having an aperture extending therethrough, said housing being mounted on said inner major surface of said fence such that said aperture is aligned with said opening, said first and second arm members being pivotally mounted in said housing, said aperture being partially closed by said first and second arm members when said first and second arm members are in the respective first positions.

5. A latching device for releasably securing a gate in a closed portion, said gate being pivotally attached at one end thereof to a fence, such that an opposite end of the gate is a free end which can be swung toward and away from the fence, said latching device comprising:

first latching means mounted on said gate adjacent said opposite end of said gate, said first latching means including a catch member projecting therefrom in a direction substantially perpendicular to a major surface of said gate;

second latching means mounted on an inner major surface of said fence, said second latching means being adapted to engage said catch member when said catch member penetrates through an opening in said fence, to retain said gate in a closed position, said second latching means including a housing having an aperture extending therethrough and first and second arm members pivotally mounted in said housing, said first and second arm members being movable between respective first positions at which respective portions of said first and second arm members extend into said aperture to close off respective portion of said aperture and respective second positions at which the respective portions of said first and second arm members are retracted out of said aperture; and user operable means for disengaging said catch member to allow said gate to be opened, said user operable means including a handle depending from said second arm member for comovement therewith and extending outwardly from said housing, an end portion of said first arm member bearing against said handle and being in slidable engagement therewith such that said first arm member biases said handle toward a closed latch position at which said first and second arm members are in the respective first positions for engagement with said catch member, said first and second arm members being disengagable from said catch member by manually operating said handle to overcome the bias exerted on said second arm member by said first arm member, whereby said first and second arm members are movable to the respective second positions.

6. The latching device of claim 5 wherein the respective portions of said first and second arm members which extend into said aperture when said first and second arm members are in the respective first positions are beveled for urging said catch member between said first and second arm members when said catch member is inserted into said aperture, said catch member being adapted to move said first and second arm members from the respective first positions to the respective second positions, to allow said catch member to penetrate past said first and second arm members, said first and second arm members returning to the respective first positions after the catch member has penetrated past said first and second arm members for retaining said catch member in a closed latch position, said first and second arm members being movable to the respective second positions to release said catch member to be retracted back through said aperture.

7. The latching device of claim 6 wherein said catch member includes an elongated shaft and an enlarged head at one end of the shaft, a leading portion of said head being rounded for slidably engaging the respective beveled portions of the first and second arm members to move the first and second arm members to the respective second positions and allow the head to penetrate past the first and second arm members, a trailing portion of said head being relatively flat to define a shoulder extending from the shaft, said shoulder for engaging respective relatively flat surfaces of said first and second arm members after the head has penetrated past the first and second arm members to retain the catch member within the aperture.

8. The latching device of claim 5 wherein said first arm member is pivoted upwardly and second arm member is pivoted downwardly in response to said first and second arm members being moved to the respective second positions, said first arm member being pivoted downwardly and said second arm member being pivoted upwardly in response to said first and second arm members being moved to the respective first positions.

9. The latching device of claim 4 wherein respective portions of said first and second arm members extend into said aperture when said first and second arm members are in the respective first positions, said respective portions being beveled for urging said catch member between said first and second arm members when said catch member is inserted into said aperture, said catch member being adapted to move said first and second arm members from the respective first positions to the respective second positions, to allow said catch member to penetrate past said first and second arm members, said first and second arm members returning to the respective first positions after the catch member has penetrated past said first and second arm members for retaining said catch member in the closed latch position, said first and second arm members being movable to the respective second positions to release said catch member to be retracted back through said aperture.

10. The latching device of claim 4 further including a handle depending from said second arm member for co-movement therewith and extending outwardly from said housing, said end portion of said first arm member bearing against said handle and being in slidable engagement therewith such that said first arm member biases said handle toward the closed latch position, said first and second arm members being disengagable from said catch member by manually operating said handle to overcome the bias exerted thereon by said first arm member, whereby said first and second arm members are movable to the respective second positions.

11. A latching device for releasably securing a gate in a closed position, said gate being pivotally attached at one end thereof to a fence, such that an opposite end of the gate is a free end which can be swung toward and away from the fence, said latching device comprising:

a catch member mounted adjacent said opposite end of said gate and projecting therefrom in a direction substantially perpendicular to a major surface of said gate;

a housing mounted on an inner major surface of said fence and having an aperture extending therethrough;

first and second arm members pivotally mounted in said housing and being movable from respective first positions at which respective portions of the first and second arm members extend into said aperture to close off respective portions of said aperture and respective second positions at which said first and second arm members are retracted out of said aperture;

a handle depending from said second arm member for co-movement therewith and extending outwardly from said housing, one end of said first arm member bearing against said handle and being in slidable engagement therewith, said first arm member biasing said handle toward a closed latch position at which the first and second arm members are in the respective first positions, said handle being manually operable to overcome the biasing force exerted by said first arm member and move the first and second arm members to the respective second positions;

said catch member being adapted to penetrate through an opening in said fence aligned with said aperture and to move said first and second arm members to the respective second positions when said catch member is inserted into said aperture, said first and second arm members returning to their respective first positions after said catch member has penetrated past said first and second arm members, for retaining said catch member within the aperture.

12. The latching device of claim 11 wherein said catch member includes an elongated shaft and an enlarged head at one end of the shaft, said head being adapted for engaging the first and second arm members to spread the first and second arm members sufficiently to allow the head to penetrate past said first and second arm members.

13. The latching device of claim 12 wherein a leading portion of said head is rounded for slidably engaging respective portions of the first and second arm members which extend into the aperture when the first and second arm members are in the respective first positions, a trailing portion of said head being relatively flat for engaging corresponding relatively flat surfaces on the first and second arm members, to retain the head within the aperture.

14. The latching device of claim 13 wherein respective portions of said first and second arm members are beveled for engaging the rounded portion of the head to urge the head between the first and second arm members, the engagement between the rounded portion of the head and the respective beveled portions of the first and second arm members separating the first and second arm members sufficiently for the head to penetrate past the first and second arm members, said first and second arm members returning to the respective first positions after the head penetrates past the first and second arm members to retain the head within the aperture.

* * * * *